United States Patent [19]

Hannay

[11] 3,968,657

[45] July 13, 1976

[54] METHOD FOR SETTING OR RESETTING POLES IN THE GROUND WITH FOAMED POLYURETHANE RESIN

[76] Inventor: Richard C. Hannay, 8111 Renmark, Houston, Tex. 77070

[22] Filed: July 19, 1974

[21] Appl. No.: 490,086

[52] U.S. Cl. ..... 61/53.5

[51] Int. Cl.[2] ..... E02D 5/26

[58] Field of Search ..... 61/36 R, 53.5, 54; 260/2.5 AK; 52/170, 742

[56] References Cited

UNITED STATES PATENTS

| | | | |
|---|---|---|---|
| 3,201,359 | 8/1965 | Herrick et al. | 260/2.5 AK |
| 3,390,119 | 6/1968 | Alexander et al. | 260/2.5 AK |
| 3,403,520 | 10/1968 | Goodman | 61/53.5 |
| 3,798,186 | 3/1974 | Nakade et al. | 260/2.5 A |
| 3,805,531 | 4/1974 | Kistner | 61/36 R |

FOREIGN PATENTS OR APPLICATIONS

| | | | |
|---|---|---|---|
| 3,921,380 | 12/1959 | Japan | 260/2.5 AK |

*Primary Examiner*—Paul R. Gilliam
*Assistant Examiner*—David H. Corbin
*Attorney, Agent, or Firm*—Plumley and Tyner

[57] ABSTRACT

An improvement in the known method of setting or resetting poles in the ground with foamed polyurethane resins formed in-situ from polyisocyanate and resin reactive therewith, is described. Ground water is often encountered in pole setting and affects polyurethane foam formation by undesirably reacting with polyisocyanate to give a foam of insufficient density and strength. This improvement comprises extending polyurethane components with a nonvolatile water-immiscible material (e.g. hydrocarbon oil) which inhibits the undesired reaction of water and polyisocyanate and reduces the unit cost of the polyurethane foam. The addition to the polyurethane composition of termite repellant materials and preservative agents for the pole is also described.

10 Claims, No Drawings

METHOD FOR SETTING OR RESETTING POLES IN THE GROUND WITH FOAMED POLYURETHANE RESIN

FOAM FORMATION $$ONC{-}P{-}NCO + 2H_2O \longrightarrow H_2N{-}P{-}NH_2 + 2CO_2$$

RESIN FORMATION $$HO{-}R{-}OH + OCN{-}P{-}NCO \longrightarrow \left[O{-}R{-}O{-}\overset{\overset{\displaystyle O}{\|}}{C}{-}NH{-}P{-}NH{-}C\right]$$

$$H_2N{-}P{-}NH_2 + OCN{-}P{-}NCO \longrightarrow \left[HN{-}P{-}NH{-}\overset{\overset{\displaystyle O}{\|}}{C}{-}NH{-}P{-}NH{-}C\right]$$

BACKGROUND OF THE INVENTION

This invention is an improvement in the invention disclosed in U.S. Pat. No. 3,403,520 which relates to a method for setting a utility pole or the like in the ground using foamed plastic instead of back filled dirt for filling the hole; and U.S. Pat. No. 3,564,859 which describes a related method for resetting a pole with foamed plastic. The entire disclosures of U.S. Pat. Nos. 3,403,520 and 3,564,859 are incorporated herein by reference.

Briefly, U.S. Pat. No. 3,403,520 discloses a method for the installation of a pole in the earth by forming a hole in the earth which is only slightly larger than the diameter of the pole where there is insufficient room for tamping tools by inserting the pole into the hole and partly filling the hole with a foamable plastic composition which is permitted to foam filling the void between the pole and the walls of the hole. Preferably, the hole is made by a device which forms a hole without soil removal. Such a device is described in U.S. Pat. No. 3,344,871 in which the hole is found by an apparatus which displaces the soil laterally and compacts the soil in the walls of the hole. U.S. Pat. No. 3,564,859 utilizes the same method of foam filling the voids resulting when an existing installed pole which has become canted or tilted.

One of the foamed plastics contemplated in these patents is polyurethane which is formed and foamed in-situ by reaction of a polyisocyanate and a resin containing active hydrogen atoms and reactive with polyisocyanate. Polyurethane resins are very well suited for use in this application but serious deficiencies are encountered when the hole to be filled with polyurethane foam contains gorund water or runoff water. In such cases, frequently encountered in many parts of the country, foam formation is not satisfactory because spongy foams having a density and strength characteristics which are too low for the purpose result from the reaction of polyisocyanate component with water.

While the source of the problem of unsatisfactory polyurethane foam formation in the presence of large amounts of water is readily apparent to those familiar with polyurethane chemistry a satisfactory solution to the problem is not evident. It is well recognized that water can be used as a foaming agent for polyurethane foams. However, the amount of water used is precisely controlled to give the amount of foaming and foam density required. The reactions involved are as follows, where OCN—P—NCO is a polyisocyanate (containing an organic radical —P— and HO—R—OH is a low molecular weight and liquid resinous material containing a long chain organic radical —R— (polyester radical chain, for example) and having groups containing active hydrogen atoms such as the OH— groups depicted.

From the foregoing simplified representations, it can be seen that the polyisocyanate (OCN—P—NCO) serves two functions; first as a resin reactant to link two or more molecules of resin (OH—R—OH) to form a larger molecule of solid resin (represented in the bracketed portion); and second, to react with polyisocyanate to form the gas $CO_2$ which serves as the blowing agent causing foam formation. Since the polyisocyanate is reactive with both water and the resin it is clear that the relative proportions of polyisocyanate, water and resin determine the density and other physical characteristics of the foamed resin. In those applications where a small and predictable amount of water is expected, those skilled in the art can make appropriate reduction in the amount of water added for foam formation, increase in the proportion of polyisocyanate, or both. In this connection, it should be noted that polyisocyanate reacts with water to form a polyamine ($H_2N$—P—$NH_2$) which itself can react with further polyisocyanate to lengthen the resinous chain. Of course, this amine and the resin HO—R—OH may both combine with polyisocyanate to form a larger resinous molecule containing both types or repeating units shown above.

As indicated above, it is possible to make appropriate adjustments in proportions if the amount of residual water can be predicted and if it is small. However, where the amount of water is likely to be large, quite unpredictable or even non-existent, as occurs in the post hole filling application of this invention, no method involving adjustment of proportions can be satisfactorily used to solve the problems associated forming polyurethane foams in the presence of ground water. It is evident that increasing the amount of polyisocyanate is undesirable from an economic standpoint since polyisocyanate is typically the most costly component of a polyurethane foam formulation. Of course, it is also not possible to pump water out of a post hole to be filled with resin since the water quickly returns and in any case remains in deleterious amounts on the surfaces. Moreover, in many areas, water may be present permanently just a few feet below the ground. One solution to the problem which has not been entirely satisfactory, is to set the pole in the ground inside a plastic bag which excludes water and to inject the foam inside the bag which is large enough in diameter to expand to fill the hole upon foam formation. However, the use of bags is cumbersome, the bags, often tear and bags of the dimensions and strength characteristics required are rather costly.

SUMMARY OF THE INVENTION

This invention provides a novel solution to the problem of formation of polyurethane foam in-situ in the presence of large amounts of water which would normally be expected to deleteriously affect foam formation. In particular, this invention provides an improvement in the known method for setting or resetting poles in the ground with polyurethane foam where ground water is often encountered.

The object of this invention is accomplished by the use of special polyurethane foam forming compositions which are more resistant to the undesired side reaction with ground water. The special polyurethane foam forming compositions contemplated herein utilize conventional polyisocyanate and reactive resin components but include a water-immiscible component. The water-immiscible component can be any of a large number of materials or even mixtures of materials, examples of which are listed below. Preferably, the water-immiscible component is a liquid having a low vapor pressure which is substantially non-reactive with either the resin or the polyisocyanate components used to form the polyurethane composition. The term "non-reactive" refers to materials non-reactive with the necessary polyurethane components under the usual conditions of foam formation.

Materials reactive with either or both of the polyurethane components are by no means excluded and may comprise part of the water-immiscible component. The preference for non-reactive water-immiscible component is primarily economic inasmuch as reaction of the water-immiscible component with a polyurethane component would most likely be with the more reactive polyisocyanate rather than the resin, reducing the amount of polyisocyanate for its essential functions of providing carbon dioxide by reaction with water and its solid resin forming function by reaction with the liquid resin. Thus, additional polyisocyanate used to make up for that in reaction with water-immiscible component would have to be added. As mentioned above, the polyisocyanate is likely to be the most costly component of the polyurethane forming system. Accordingly, the amount of polyisocyanate is desirably kept to a minimum.

Another preferred characteristic of the water-immiscible component is that it have a low vapor pressure; that is that it be relatively non-volatile. However, fairly volatile components are operative and are not excluded. By "low vapor pressure" it is meant that the component has a vapor pressure lower than water at ordinary temperatures, e.g. 70°F. At 70°F. the vapor pressure of water is less than 20 mm. Hg. Accordingly, water-immiscible components with a vapor pressure of less than 20 mm. Hg. most preferably less than 1 mm. Hg. at about 70°F. are intended by the expression "having a low vapor pressure".

It is also preferred that the water-immiscible component be fluid at ordinary temperatures, e.g. 70°F. or at least that the complete polyurethane forming composition comprising polyisocyanate, resin reactive with polyisocyanate, water (for foaming), water immiscible component plus any other additives, be fluid at such ordinary temperatures.

By "water-immiscible" it is meant that the solubility in water at about 70°F. is less than 5 g per 100 g. of water and preferably less than 1 g per 100 g of water.

Most preferably, the water-immiscible component has no measurable solubility in water.

Among the water-immiscible components having a low vapor pressure as contemplated herein are the higher alkanes ($C_8$ and above), crude oil, petroleum oils and higher petroleum fractions of all kinds pure and crude, asphalts, tars, petroleum refining bottom or residues, and the like. Components which are comprised primarily of aromatic or aliphatic or hydrocarbons, pure or crude and consequently not reactive with polyisocyanate are particularly preferred. Also, contemplated are materials such as coal tar pitch, wood tar pitch, tall oil and tall oil derivatives, and wax. Solid materials which are water insoluble are suitable as the water-immiscible component particularly if they are dissolved in another liquid water-immiscible component. Thus, such combinations are specifically contemplated. Finally, halogenated hydrocarbons and halogen derivatives of the foregoing can be used in the practice of this invention.

The added water-immiscible component necessary to this invention is to be distinguished from the usual essential components of a polyurethane foam system, namely polyisocyanate and resin which are normally water-immiscible in themselves. As indicated above, it is preferred that the water-immiscible component be non-reactive with the essential polyurethane components. Once this preference is satisfied the ratio of water-immiscible component to the remainder of the polyurethane foam forming composition is not critical. The essential considerations for selecting appropriate proportions are that enough of the water-immiscible component be present to inhibit the reaction with water and that excesses of the water-immiscible component resulting in unacceptable deterioration of the physical characteristics of the final foam be avoided. Consistent with the foregoing requirements operative polyurethane foams can be obtained from compositions containing 10% to 80% by weight of water-immiscible components. Preferably, the amount of water-immiscible component is in the range of 30% to 60% by weight of the polyurethane foam forming compositions.

Polyurethane compositions suitable in this invention and particulaly suitable water-immiscible components are disclosed in U.S. Pat. No. 3,810,860 which is incorporated by reference for teaching of polyurethane components and crude petroleum components corresponding to the water-immiscible component herein. Several of the ingredients considered necessary in that U.S. Pat. No. 3,810,860 such as the organic acid are not necessary herein. Nor is this invention limited to the proportions of ingredients mentioned in U.S. Pat. No. 3,810,860.

The blowing agent responsible for foam formation can be any of the agents known in the art as blowing agents for polyurethane foams. Water is preferred. However, in some applications where it is desired to obtain faster foam formation or to produce a foam of less density, it may be advantageous to replace some or all of the water with a volatile halogenated hydrocarbon such as the "Freons" which are well known in this application.

It is also known in the art of preparing plastic foams that solid extenders and solid fillers can be advantageously used to reduce cost and achieve desirable characteristics. The use of such fillers and extenders consistent with the obtention of the necessary foam characteristics is contemplated in this invention. Indeed, solid fillers or extenders which serve to reduce corrosion of metals, reduced rotting and termite infestation of wood, can be highly beneficial. On the other hand, fillers and extenders which tend to be corrosive in themselves, are to be avoided. Corrosion problems are often quite complex and depend not only on the exact nature of the metal but also on the precise mechanism of corrosion. Accordingly, the choice of inhibitor will depend on many factors. However, pigments and fillers such as red lead (Pb O), zinc dust, and zinc chromate (ZnCrO) have been effectively used where corrosion of iron or steel is caused by oxidation. Bacteriostats have been employed in controlling corrosion of iron and steel caused by anaerobic bacteria. Further information on corrosion and corrosion prevention can be found in Uhlig, *CORROSION AND CORROSION CONTROL*, Second Edition, John Wiley and Sons, New York, 1971. Similarly known wood peservatives and termite repellants can be incorporated into the foams of this invention.

FORMULATION OF FOAMABLE COMPOSITIONS

The foamable compositions utilizable in this invention can vary widely within the requirements mentioned above. The following is representative of such formulations in which all parts are by weight.

| | |
|---|---|
| 20 to 25% | PAPI 135 (polymeric diphenylmethyl diisocyanate) |
| 5 to 10% | Quadral (N,N,N',N'-tetrakis(2-hydroxypropyl)-ethylene-diamine |
| 50 to 60% | Curde oil (or Exxon S-2 tar) |
| 6 to 12% | Freon 11 |
| 8 to 12% | Dow Polyol RN 490 |
| 0.1% | Tertiary amine catalyst |
| 0.3% | Surfactant |
| 0 to 0.2% | Water |

I claim:

1. In the method of setting or resetting a pole or the like in earth with a foamed polyurethane composition which is formed in-situ by reacting organic polyisocyanate with an organic active hydrogen containing component reactive therewith; the improvement comprising utilizing polyurethane resin forming components including organic polyisocyanate and an organic active hydrogen containing material reactive therewith, said composition containing as an additional ingredient, a liquid water-immiscible component in an amount effective to allow formation of a foam of sufficient strength for holding the pole in the presence of water by inhibiting the reaction of the polyisocyanate with water.

2. The method of claim 1 which is conducted under conditions which would result in insufficient foam strength in the absence of said liquid water-immiscible component.

3. The method of claim 1 in which the polyol is N,N,N',N'-tetrakis(2-hydroxypropyl)-ethylene-diamine.

4. The method of claim 1 in which the amount of said liquid water-immiscible component is 10% to 80% by weight of the total polyurethane foaming composition.

5. The method of claim 1 in which the amount of said liquid water-immiscible component is 30% to 60% by weight of the total polyurethane foaming composition.

6. The method of claim 1 in which the liquid water-immiscible component has a vapor pressure of less than 20 mm Hg at 70°F and is present in an amount of 10% to 80% by weight of the total polyurethane foaming composition.

7. The method of claim 6 in which the liquid-immiscible component comprises petroleum refinery bottoms or residues.

8. The method of claim 6 in which the liquid water-immiscible component has a solubility in water of less than 1 g. per 100 g. of water at 70°F.

9. The method of claim 1 in which the major proportion of said liquid water-immiscible component is unreactive with the polyurethane foam forming components.

10. The method of claim 1 in which said polyisocyanate is diphenylmethane diisocyanate.

* * * * *